US006599180B2

(12) United States Patent
Seagle

(10) Patent No.: US 6,599,180 B2
(45) Date of Patent: Jul. 29, 2003

(54) ANTI-THEFT COIN MONITORING SENSOR UNIT FOR A COIN HOPPER DISPENSER

(75) Inventor: Donald Lee Seagle, Sandy Valley, NV (US)

(73) Assignee: Asahi Seiko USA Inc., Las Vegas, NV (US)

( * ) Notice: Subject to any disclaimer, the term of this patent is extended or adjusted under 35 U.S.C. 154(b) by 26 days.

(21) Appl. No.: 09/827,050

(22) Filed: Apr. 5, 2001

(65) Prior Publication Data

US 2002/0146975 A1 Oct. 10, 2002

(51) Int. Cl.[7] ..... G07F 9/02; C07D 1/00
(52) U.S. Cl. ..... 453/32; 453/57; 194/200
(58) Field of Search ..... 194/200; 453/32, 453/57

(56) References Cited

U.S. PATENT DOCUMENTS 4,359,147 A * 11/1982 Levasseur ..... 194/200
4,360,034 A * 11/1982 Davila et al. ..... 221/182
4,589,433 A * 5/1986 Abe ..... 221/203
4,620,559 A * 11/1986 Childers et al. ..... 194/346
5,097,934 A * 3/1992 Quinlan, Jr. ..... 194/200
5,123,873 A * 6/1992 Rasmussen ..... 453/10
5,647,469 A * 7/1997 Yamagishi et al. ..... 194/200
5,980,089 A * 11/1999 Weis ..... 194/200
6,155,398 A * 12/2000 Sagady ..... 194/200
6,179,704 B1 * 1/2001 Suzuki ..... 194/202

OTHER PUBLICATIONS

Pepperl+Fuchs Group, http://www.pepperl–fuchs.com.*
Schan Electric Corp., http://www.schanelecsz.com/m12m18.html.*

* cited by examiner

*Primary Examiner*—Eileen D. Lillis
*Assistant Examiner*—Thuy V. Tran

(57) ABSTRACT

A coin dispensing apparatus can sequentially dispense coins through a passageway to a discharge location. A coin sensor unit can be operatively mounted to monitor the movement of coins along the coin passageway to provide an output signal representative of movement of the coins through the passageway. A comparator circuit can compare the output signal with a predetermined threshold value and when the alarm signal is equal to or greater than the threshold value, it can activate a control circuit for activating an alarm signal indicating an abnormal condition in the coin dispensing apparatus.

17 Claims, 4 Drawing Sheets

PRIOR ART

ANTI-THEFT COIN MONITORING SENSOR UNIT FOR A COIN HOPPER DISPENSER

BACKGROUND OF THE INVENTION

1. Field of the Invention

The present invention relates to an apparatus for dispensing coins or tokens such as a coin hopper dispensing apparatus that can store coins or tokens in bulk and more particularly to a coin monitoring sensor unit that can monitor unauthorized and abnormal operation of the coin hopper.

2. Description of the Related Art

It has been known to use coin hoppers particularly in game machines 50 as shown in FIG. 4. A coin hopper 51 is mounted within the housing of the game machine and can dispense coins to a disposition opening or tray 52. A coin input aperture 53 is conveniently located next to the console of the game machine 50.

The coin hopper can be of the configuration disclosed in U.S. Pat. No. 4,589,433 and can be explained with reference to the prior art FIG. 5. A lower support base 61 can be mounted in a level position within a secure game housing to horizontally support a vertical hopper base 62 at an angle of about 60 degrees to the lower support base 61. The hopper base 62 is approximately circular and supports a coin retention compass bowl 68 for receiving bulk coins or medallions. As understood, a coin, as used in the present specification, can include besides monetary coins or currency, medallions, tokens, and other discs.

A motor 63 can be mounted on the back surface side of the hopper base 62 and can be connected to a speed reducing transmission assembly which in turn rotates a rotating disc member 64. The outer peripheral or margin portion of the rotating disc 64 has a stepped or leveled difference 65 to form a coin carrying plane 66. A plurality of section check pins 67 can be fixed at regular intervals about the coin carrying plane 66 and spaced to accommodate a particular size coin. The coin retention compass bowl 68 surrounds the circumference of the rotating disc 64, and at the top portion of the disc 64 is a reception knife member having an entrance tip in the form of a triangle. The base of the reception knife 69 is fixed to the hopper base 62. The tip of the reception knife 69 is positioned close to the leveled difference 65 to assist in separating the coins picked up by the rotating disc 64. The coin counter unit 70 has a fixation shaft 71 which pivotally supports a lever 72 and a roller 73. A coin counting sensor (not shown) can detect the movement of the lever 72. The fixation shaft 71 is fixed to the hopper base 62 and the lever 72 is movably mounted on the fixation shaft 71. The roller 73 is positioned at the tip of the lever 72. The lever 72 can be biased by a spring (not shown) is a counter-clockwise rotational direction. A coin passageway 75 is formed between the hopper base 62 and a guide board member 74 and communicates with the upper surface of the knife 69. At the end of the coin passageway 75, a coin exit slot 76 is provided.

When an operator activates the game machine 50, shown in FIG. 4 by inserting a coin in the coin reception aperture 53, a game is commenced. The inserted coin is guided by a duct (not shown) so that it is positioned within the coin retention compass bowl 78 of the coin hopper 51. A control circuit in the game machine 50, for operating the play of the game, can generate a disposition signal for the dispensing of coins when appropriate during the playing of the game machine. When this occurs, the motor 63 starts rotating to cause the rotating disc 64 to rotate in a counter-clockwise rotational direction through the coin retention compass bowl 68. The coins are stirred and selected in the coin carrying plane 66 when they contact the section checkpins 67. The peripheral edge of the coin is supported by the leveled difference 65. The coin is elevated as the rotating disc 64 rotates so that the coin eventually reaches the reception knife 69. As the rotating disc continues to rotate, this coin is supported on the upper surface of the reception knife 69, while it is pushed by the rotating disc. The coin is forced into the coin passage 75 by the section checkpin 67. As it passes into the coin passageway 75, it pushes up the roller 73 and causes the lever 72 to rotate in a clockwise direction. The movement of the lever 72 is detected by a count sensor (not shown). The count sensor thereby emits a count indicating the disposition of one coin. A control circuit in the game machine 50 can compare the count signals to the set number of coins that are to be discharged. When the count number reaches this comparison value, the control circuit will output a stop signal to the motor 63. By this operation, the appropriate number of coins are discharged through the coin passageway 75 so that they can be paid to the user at the coin exit 76. The coins are then discharged to the tray 52.

When the motor 63 is activated to dispense coins, the coin counter unit 70 can be monitored so that if a coin is not sensed within a predetermined time period, a warning signal is activated. Additionally, if the coin counter unit 70 provides a constant output for a predetermined time period, a warning signal is also activated. It is possible for a coin to pass the roller 73, and due to a blockage in the coin passageway 75, be ejected back into the coin hopper 51 without indicating a warning signal.

Problems have occurred in that attempts have been made to illegally obtain coins from the game machine by blocking the tray 52, thereby causing the coin exit 76 to be closed and forcing the coins to back up within the coin passageway 75. As a result, when the coins block the passageway 75, the motor 63 will detect a jam because it becomes overloaded and may automatically stop. The player can then hide the number of coins that have been already paid before the exit was jammed and can claim to the attendant that he was improperly prevented from being paid the actual number of coins that he was entitled to because of the jam. The attendant, upon inspecting the game machine, will be aware of the number of coins that were to be discharged based upon the play of the game, and will also be aware that the machine jammed, thereby being encouraged to pay the player an unjustified number of coins.

The prior art is still seeking an economical manner in which to prevent this fraudulent operation of the game machine.

SUMMARY OF THE INVENTION

The present invention provides an anti-theft coin monitoring sensor unit that can be installed in a coin dispensing apparatus that sequentially dispenses coins through a coin passageway to a discharge location, for example in a gaming machine. A coin sensor unit is operatively mounted to monitor the movement of coins along the coin passageway and to provide a representative output signal of this movement of the coins. A photo sensor or a proximity sensor can measure the relative movement of the coin along the coin passageway and produce a corresponding output signal. An integration circuit can take the output signal from the coin sensor and format the output signal. A comparator circuit can receive the output signal for comparing the output signal with a predetermined threshold value. A control circuit can activate an alarm signal when the output signal is equal to or greater than the threshold value. The alarm signal indicates an abnormal condition in the coin dispensing apparatus such as the jamming of coins in the coin passageway. When the coins are held stationary in front of the coin sensor, the output signal continues to build in value until it passes the threshold value to thereby activate the alarm signal.

A microprocessor system can be utilized wherein a coin sensor produces an analog output signal which is converted to a digital value. The digital value can then be compared, for example with a set count value to set forth a predetermined threshold value. When the predetermined threshold value is reached, the microprocessor can activate appropriate audible and visible alarms and can control the activation of a motor which is utilized to pick up and dispense the coins.

The anti-theft coin monitoring sensor unit can be sold as a modification kit for modifying a pre-existing coin hopper dispenser. Alternatively, a coin dispensing apparatus can be manufactured to include a hopper for storing coins with a rotatable coin selecting disc member operatively connected to the hopper for selectively picking up coins. A motor can drive the rotatable coin selecting disc member to dispense coins through a coin passageway so that they are appropriately discharged from the coin dispensing apparatus. A coin counting unit can count the coins that are provided in the coin passageway. A coin sensor unit is operatively mounted to the coin passageway downstream of the coin counting unit to provide an output signal representative of the movement of the coins to the coin passageway. A comparator circuit can compare the output signal with a predetermined threshold value and a control circuit can activate an alarm signal when the output signal is equal to or greater than the threshold value whereby the alarm circuit will indicate an abnormal condition in the coin dispensing apparatus.

DETAILED DESCRIPTION OF THE PREFERRED EMBODIMENT

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein to specifically provide an anti-theft coin controlling sensor unit for a coin dispensing apparatus.

Figure 1:
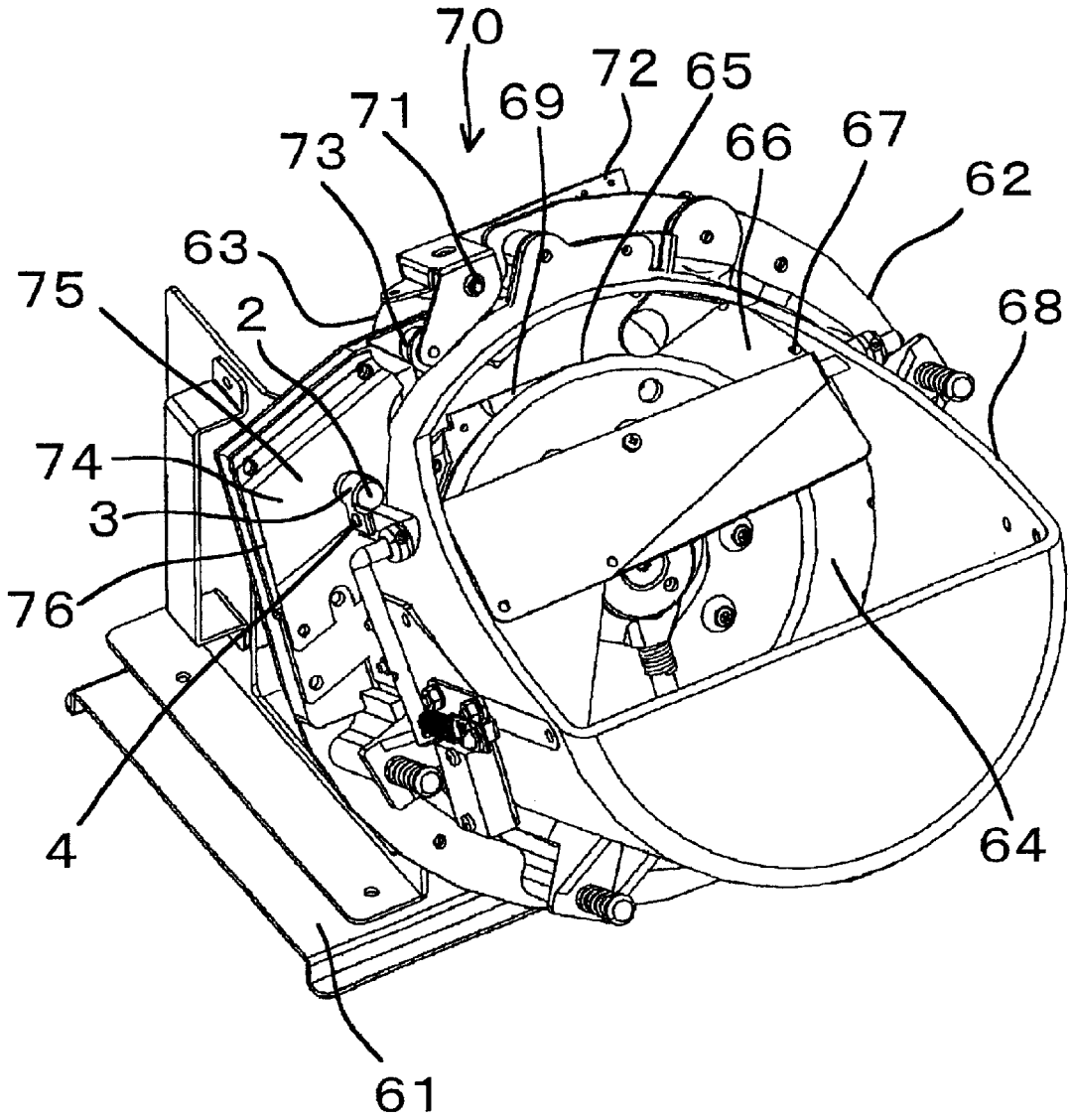
FIG. 1 is a perspective view of a coin hopper dispensing apparatus incorporating an anti-theft coin controlling sensor unit of the present invention.
Figure 2:
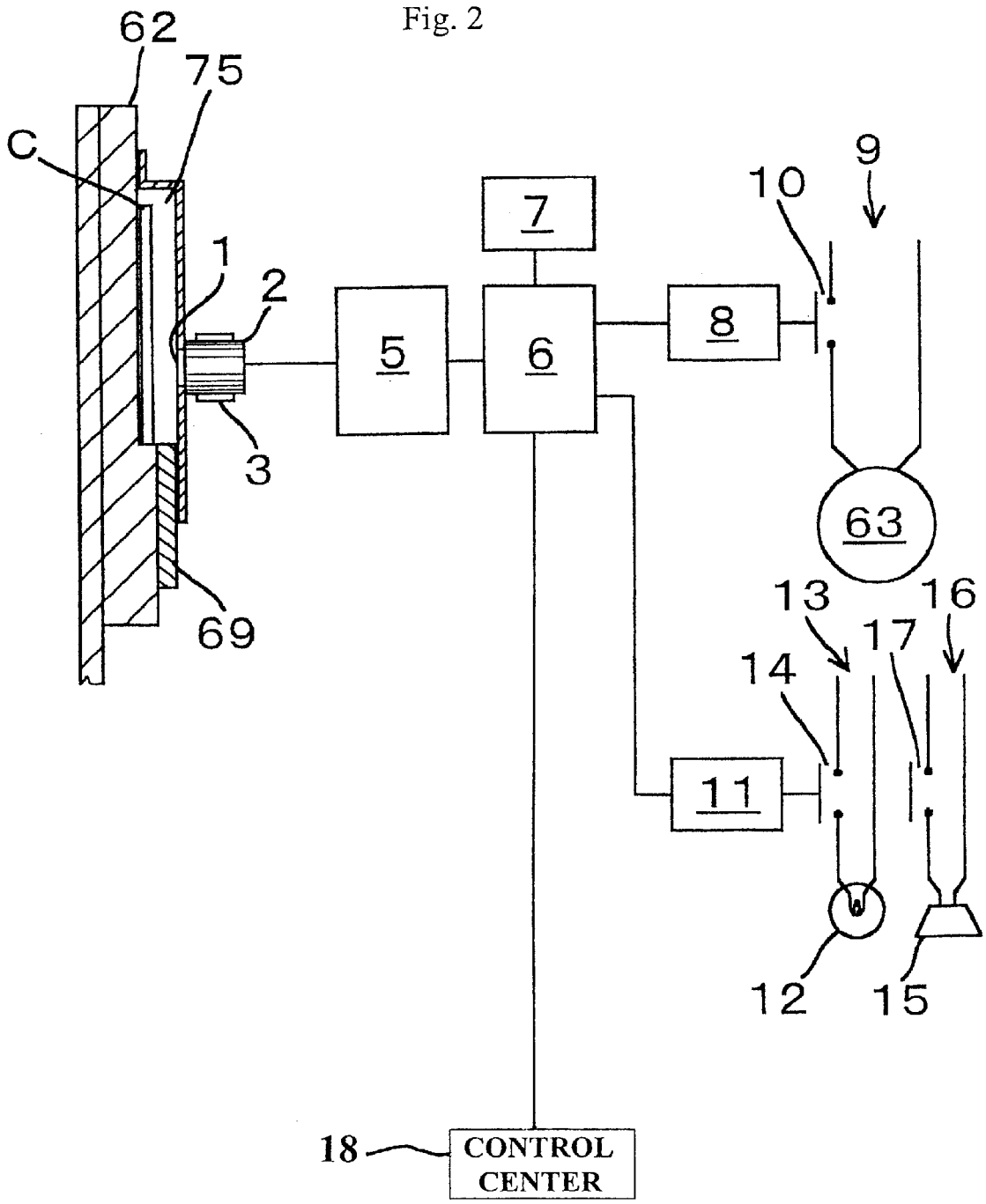
FIG. 2 is a partial cross-sectional view and schematic of the sensor unit assembly.

The present invention can be installed as original equipment on a gaming machine coin hopper dispensing apparatus and can be further provided as an after-market modification kit to existing coin hopper dispensing apparatus as a safeguard against the unauthorized pilfering of coins. Referring to FIGS. 1 and 2, the present invention provides a coin sensor unit that incorporates a coin sensor 2 such as a photo sensor that can be positioned to monitor the coin passageway 75 downstream from the roller 73. The guide board 74 can be provided with an aperture 1 which can be mounted within a metal bracket fitting 3 that can be held by a screw 4 in an operative position. The screw 4 can be fixed into the sidewall of the coin retention compass bowl 68. As can be appreciated, an existing machine can be modified by drilling a hole or aperture within the guide board 74 and mounting the coin sensor 2 in an operative position relative to the hole. While the present embodiment discloses an optical photo sensor 2 which can be of a reflection type, where it senses light reflected from the coin as it passes in front of the photo sensor, the photo sensor can, in an alternative embodiment, be of a transmission type where a light source is provided on the other side of the passageway and a coin will block the transmission of light to the photo sensor 2. Other forms of coin sensors can be utilized, such as a proximity sensor, that can measure a change in an electrical characteristic when a coin is present as known in this field such as the Allen-Bradley Model No. 871C series of sensors. The body of the photo sensor 2 can be held within the belt-like metal bracket fitting 3.

The output signal from the coin sensor 2 is input into an integrating circuit 5 and the output of the integrating circuit can then be applied to a comparator circuit 6. The comparator circuit 6 can discriminate the output signal with a predetermined comparison value provided by a comparison value setting circuit 7. The resulting output of the comparator circuit 6 can be provided to a motor control circuit 8 for the motor 63. The motor control circuit 8 can control a switch or contact 10 in a power feed circuit 9 when an abnormal signal is determined from the comparator circuit 6. In addition, the output of the comparator circuit 6 can also be input into an alarm control circuit 11 that is also capable of closing a relay or contact switch 14 to activate a visual alarm lamp 12 that is fed by a power circuit 13. Simultaneously, another contact or relay switch 17 can activate an alarm loud speaker 15 which is fed by a power circuit 16. The control of the motor and alarm can be controlled by a single control circuit.

The comparator circuit 6 can also provide a signal to a central control center 18 that monitors the gaming area with video cameras to alert surveillance of a possible problem at the game machine.

Thus, upon the detection of an abnormal condition, both an alarm light and an audio signal can be generated. As can be appreciated, it is also possible to send an alarm signal silently to a control center to alert surveillance to monitor the gaming machine and the activities of the player.

Figure 3:
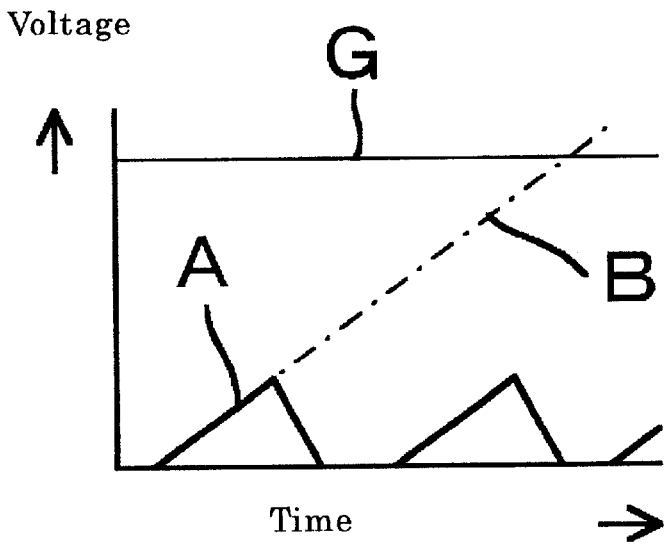
FIG. 3 is a diagram of the signal output of an integrating circuit.
Figure 4:
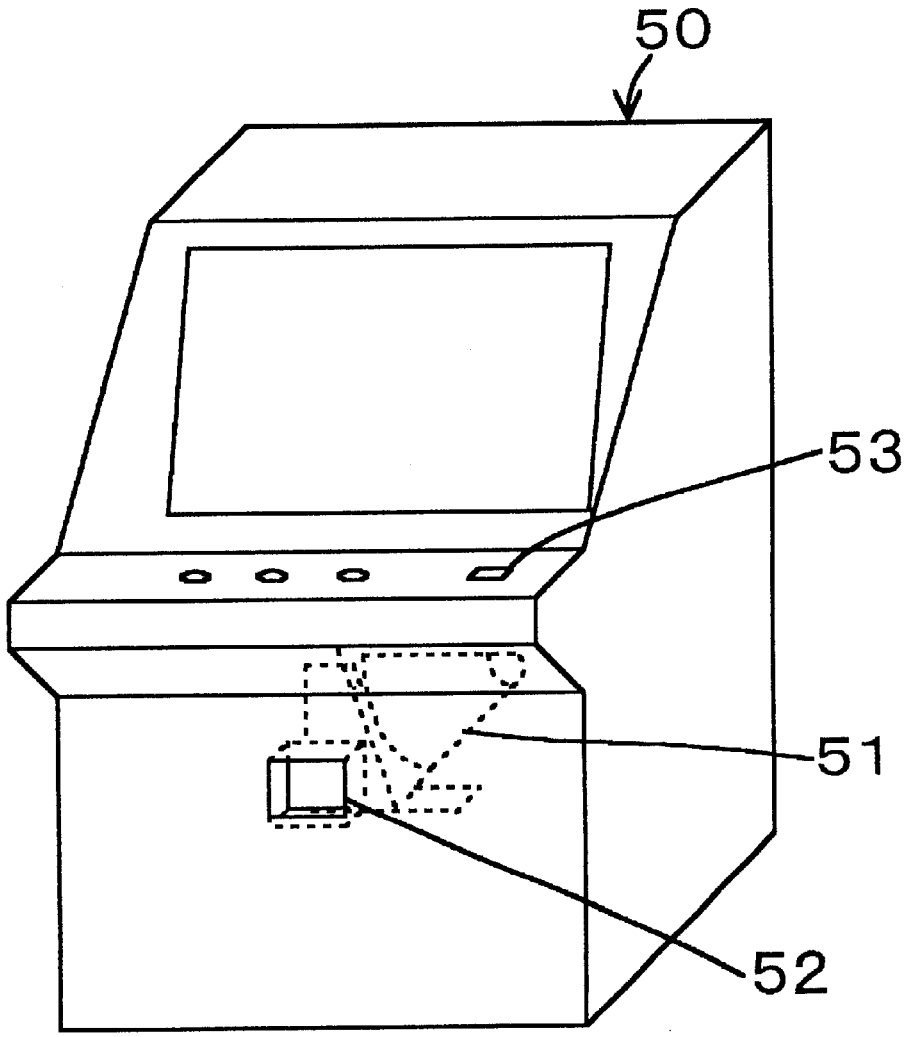
FIG. 4 is a schematic perspective view of a gaming machine.
Figure 5:
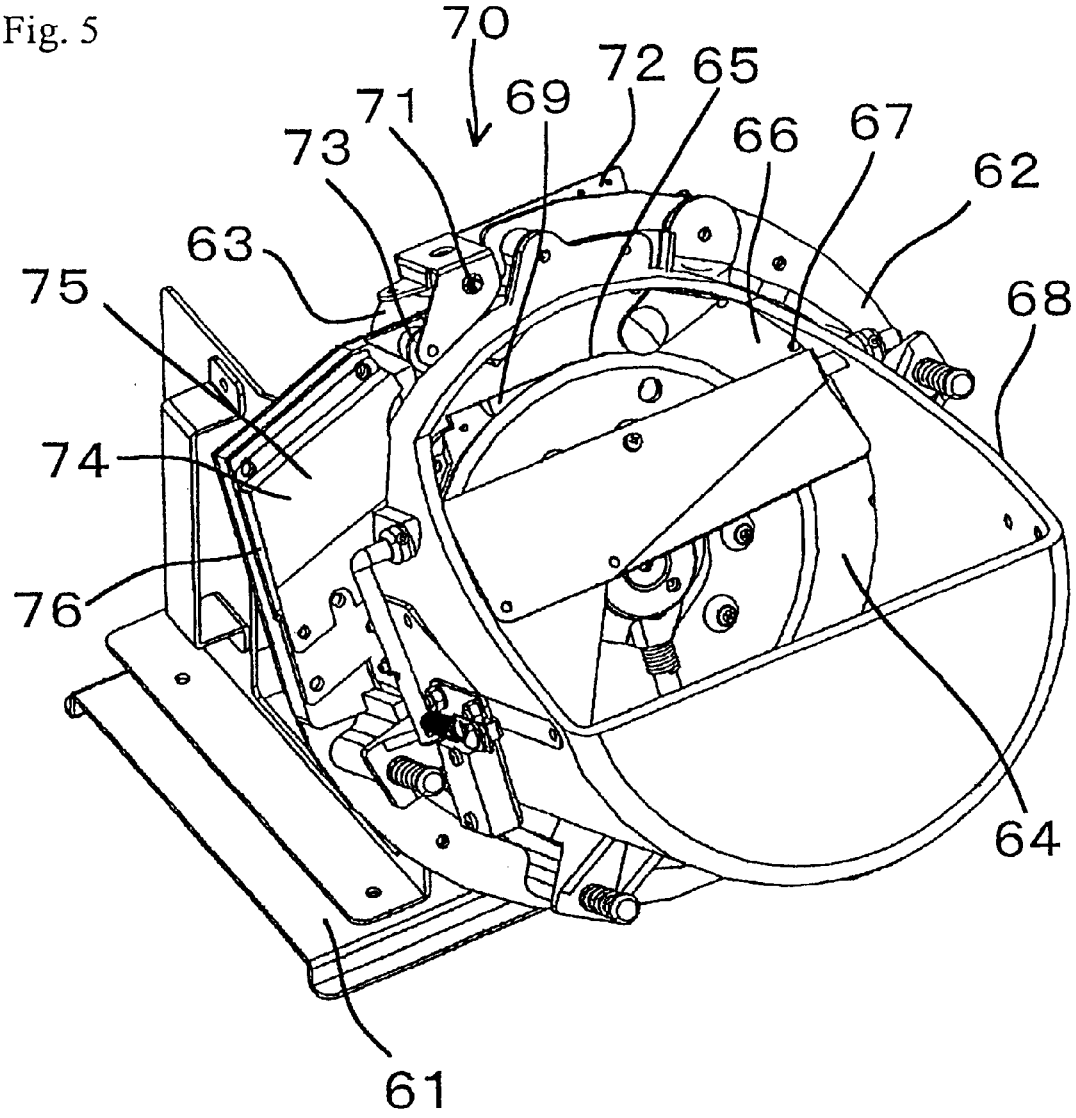
FIG. 5 is a description of a prior art coin dispensing apparatus.

In the normal course of operation, when a coin is being discharged from the coin hopper, it is released into the coin passageway 75 and will pass the coin sensor 2. In this regard, if the coin sensor 2 is a photo sensor that is picking up the reflection of light that it generates into the passageway 75, the output of this reflected light as the coin C passes in front of the photo sensor 2 will generate a signal as shown in FIG. 3, wherein the voltage will proportionately increase and decrease over a time period associated with the passage of the coin C in front of the coin sensor 2. The voltage value will generally rise as an output of the integrating circuit 5 and then fall to create the triangular output signal shown in FIG. 3. As a series of coins C are normally discharged through the coin passageway, a series of serrated output signals will be generated as shown by the signal A in FIG. 3. The output of the integrating circuits 5 will be provided to the comparative circuit 6 and a comparison value setting circuit 7 will provide a threshold level G as shown in FIG. 3.

As long as the threshold level G has not been exceeded, the coins C are translating in a normal and proper manner to the coin passageway 75 and the comparator circuit 6 will not output an alarm signal.

If an attempt is made to jam or close the coin exit 76, the coins will accumulate in the coin passageway 75, and will force a coin to be held stationary in front of the coin sensor 2 before the coins back up to jam and stop the motor 63. The output of the coin sensor 2, as shown by the dotted line B in FIG. 3, exceed the comparison value G and activate the alarm. The sudden activation of alarm sounds and lights at the gaming machine would generally cause the player to cease his efforts to block the coin passageway 75. As shown in FIG. 2 in the preferred embodiment, the comparator circuit 6 will also output an abnormal signal to the motor control circuit 8 to release the contact 10 thereby cutting power to the motor 63 to stop the movement of the rotating discs 64 and the dispensing of the coins. Additionally, the alarm control circuit 11 is activated to close the contact for the alarm lamp 12 and its power circuit 13 so that the alarm lamps will be lit. Simultaneously, the contact 17 of the alarm loud speaker 15 will close the power circuit 16 so that the alarm loud speaker 15 will emit an audible alarm. The attendant for the gaming machines can respond to the alarm lamp 12 and the alarm loud speaker 15 to address the problem.

Variations in implementing a response to an abnormal or jammed signal from the comparator circuit 6 is possible. For example, it could be possible to automatically stop only the motor 63 and/or only the alarm lamp 12 may be lit. In addition, it would be possible to only activate the alarm loud speaker 15.

In addition, it is desirable that the light that is output by the coin sensor 2 that is to be reflected back from the passageway is configured in such a manner to ensure a substantial contrast when a coin passes the coin sensor 2 in the coin passageway 75.

It is also possible to provide a micro-processor based control system wherein the analog output of the coin sensor 2 can be converted into a digital signal which can be appropriately counted as representative of the coin passage. A comparison can be made with a pre-set counter value indicative of an abnormal or jammed state of the passageway 75 and when that threshold is exceeded, the microprocessor can be programmed to provide signals for controlling the motor 63, alarm lights and loud speaker alarms through an appropriate control circuit.

In summary, a coin dispensing hopper of the present invention can be provided with a rotating coin selecting disc having a configuration to selectively pick up coins from the hopper with checkpins. A motor can drive the rotating coin selecting disc so that the coins are picked up and applied to a separating member such as a knife edge to selectively remove the coins from the rotating coin selecting disc and introduce them into a coin passageway. An anti-theft coin sensor assembly can be installed within the coin passageway and connected to a discrimination circuit that is capable of indicating an alarm condition when an output signal from the coin sensor continues beyond a fixed time period to exceed a predetermined threshold value. When the coins are blocked within the coin passageway, the coin sensor circuit is capable of accumulating the progressively increasing value, so that when it passes the threshold value, it indicates an alarm signal. The alarm signal can be utilized to activate various forms of alarm conditions, such as an alarm sound, flashing lights, and an alarm signal to a central control monitoring center that is frequently utilized in casinos for monitoring the operation of gaming machines with video cameras.

The alarm signal can also activate a control circuit to stop the output drive of a motor which is driving the rotating coin selecting disc for selecting the coins so that the continued disposition of the coins can be stopped.

The anti-theft coin monitoring sensor unit of the present invention can be installed as original equipment or as auxiliary equipment and can monitor the passageway of a coin dispenser downstream from the conventional coin counters in a gaming machine.

Those skilled in the art will appreciate that various adaptions and modifications of the just-described preferred embodiments can be configured without departing from the scope and spirit of the invention. Therefore, it is to be understood that, within the scope of the appended claims, the invention may be practiced other than as specifically described herein.

What is claimed is:

1. In a coin dispensing apparatus that sequentially dispenses coins through a coin passageway to a discharge location, the improvement comprising, a coin sensor unit operatively mounted to monitor an accumulation of coins at the coin passageway to provide an output signal representative of the accumulation of the coins at the coin passageway, the passageway is defined by surrounding walls;

a comparator circuit for comparing the output signal with a predetermined threshold value;

a control circuit for activating an alarm signal when the output signal is equal to or greater than the threshold value whereby the alarm signal will indicate an abnormal condition in the coin dispensing apparatus; and a motor for driving a selecting disc to dispense coins wherein the control circuit stops activation of the motor when the alarm signal is produced.

2. The coin dispensing apparatus of claim 1 wherein the coin sensor unit includes a photo sensor.

3. The coin dispensing apparatus of claim 2 wherein the coin sensor unit includes an integration circuit for providing the output signal based on a quantity of light measured.

4. The coin dispensing apparatus of claim 2 wherein the photo sensor measures reflected light.

5. The coin dispensing apparatus of claim 1 wherein the coin sensor unit includes a proximity sensor.

6. The coin dispensing apparatus of claim 1 wherein the control circuit activates a audible alarm.

7. The coin dispensing apparatus of claim 1 wherein the control circuit activates a light emitting alarm.

8. The coin dispensing apparatus of claim 1 wherein including a mounting bracket assembly attached to the coin dispensing apparatus adjacent an aperture communicating with the coin passageway, the aperture is of a dimension to receive a coin sensor held by the mounting bracket.

9. A coin dispensing apparatus comprising:

a hopper for storing coins;

a rotatable coin selecting disc member operatively connected to the hopper for selectively selectively picking up coins;

a motor for driving the rotatable coin selecting disc member;

a coin passageway operatively positioned relative to the rotatable coin selecting disc member for receiving coins from the rotatable coin selecting disc member and discharging the coins from the coin dispensing apparatus;

a coin counting unit for counting the coins provided into the coin passageway;

a coin sensor unit operatively mounted to monitor the accumulating coins at the coin passageway to provide an output signal representative of the accumulating coins at the coin passageway, the passageway is defined by surrounding walls;

a comparator circuit for comparing the output signal with a predetermined threshold value; and a control circuit for activating an alarm signal when the output signal is equal to or greater than the threshold value whereby the alarm signal will indicate an abnormal condition in the coin dispensing apparatus.

10. The coin dispensing apparatus of claim 9 further including a motor for driving a coin selecting disc to dispense coins wherein the control circuit stops activation of the motor when the alarm signal is produced.

11. The coin dispensing apparatus of claim 9 wherein the coin sensor unit includes a photo sensor.

12. The coin dispensing apparatus of claim 11 wherein the coin sensor unit includes an integration circuit for providing the output signal based on a quantity of light measured.

13. The coin dispensing apparatus of claim 11 wherein the photo sensor measures reflected light.

14. The coin dispensing apparatus of claim 9 wherein the coin sensor unit includes a proximity sensor.

15. The coin dispensing apparatus of claim 9 wherein the control circuit activates a audible alarm.

16. The coin dispensing apparatus of claim 9 wherein the control circuit activates a light emitting alarm.

17. The coin dispensing apparatus of claim 9 further including a mounting bracket assembly attached to the coin dispensing apparatus adjacent an aperture communicating with the coin passageway, the aperture is of a dimension to receive a coin sensor held by the mounting bracket.

* * * * *